United States Patent [19]

Locke et al.

[11] Patent Number: 4,700,476

[45] Date of Patent: Oct. 20, 1987

[54] SHAVER FOR A MEDICAL TREATMENT PREPARATION PROCEDURE

[75] Inventors: David R. Locke, Bridgeport; Aivars Miska, Stratford, both of Conn.

[73] Assignee: Remington Products, Inc., Bridgeport, Conn.

[21] Appl. No.: 667,647

[22] Filed: Nov. 2, 1984

[51] Int. Cl.[4] ..... B26B 19/02

[52] U.S. Cl. ..... 30/43.91; 30/220

[58] Field of Search ..... 30/90, 34.1, 43, 43.91, 30/43.92, 218, 220

[56] References Cited

U.S. PATENT DOCUMENTS

| | | | |
|---|---|---|---|
| 3,672,049 | 6/1972 | Demci | 30/90 |
| 3,869,790 | 3/1975 | Ihasz | 30/90 |
| 4,262,415 | 4/1981 | Braun | 30/90 X |
| 4,348,810 | 9/1982 | Oda et al. | 30/210 |
| 4,512,077 | 4/1985 | Tanabe et al. | 30/43 |

*Primary Examiner*—Frank T. Yost

*Assistant Examiner*—Eugenia A. Jones

[57] ABSTRACT

An improved method and apparatus for preparing a body site prior to the application of medical treatment at the site is disclosed. The apparatus and method provide for the use of a hand-held, electrically-energized clipper having a disposable cutter head for removal of body hair at the site. An economical, disposable cutter head is described.

25 Claims, 12 Drawing Figures

Fig. 1.
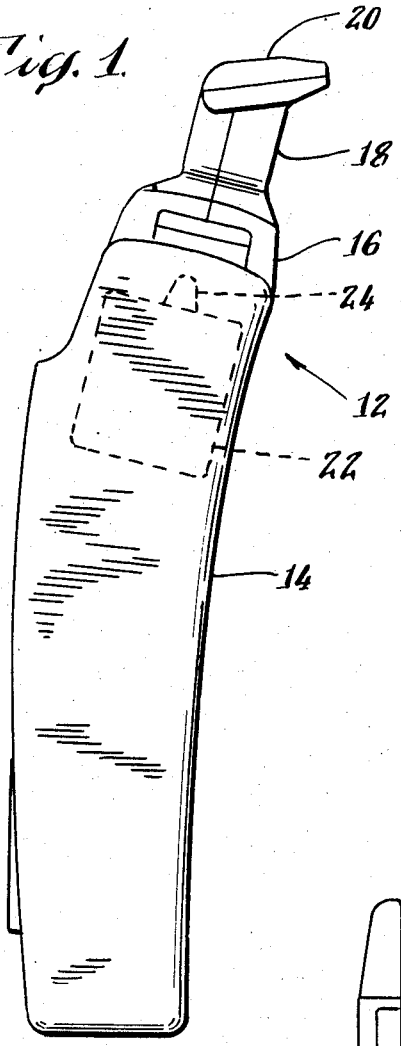
Fig. 2.
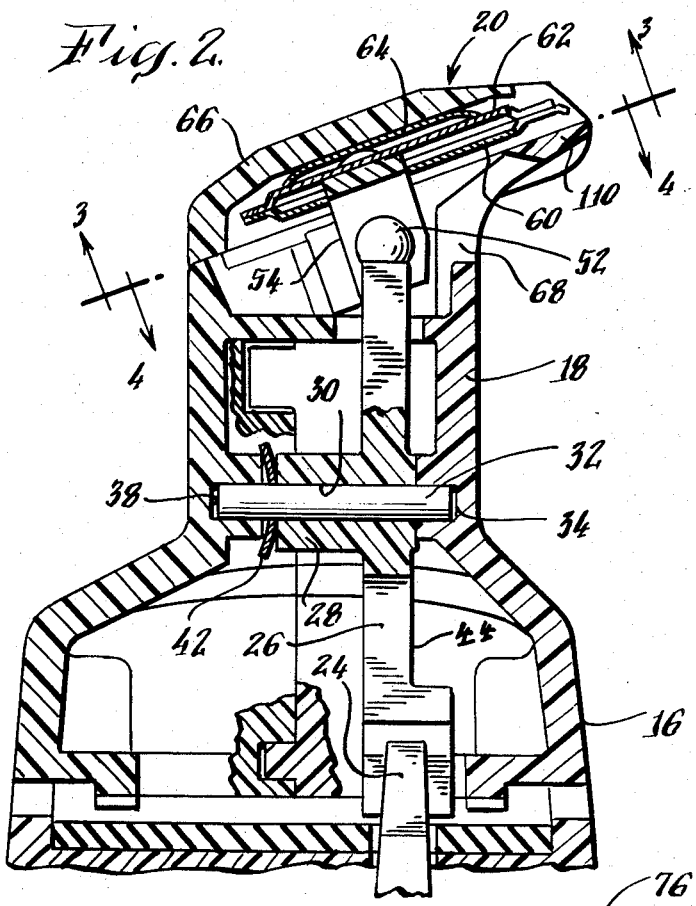
Fig. 3.
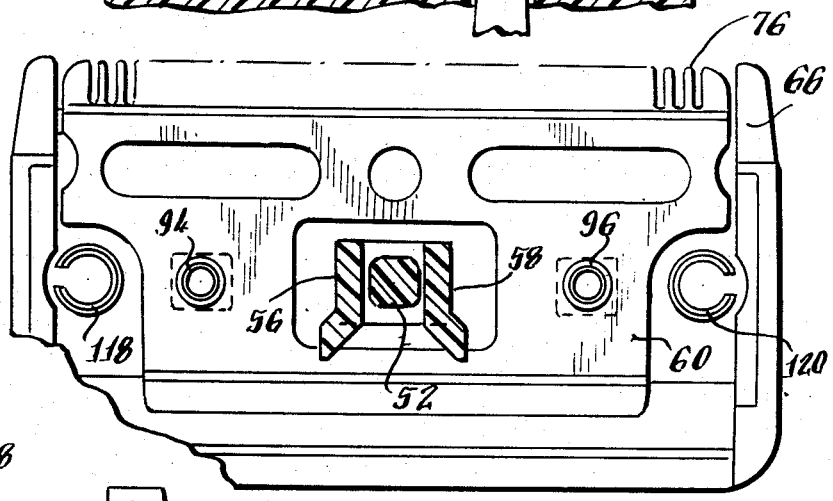
Fig. 4.
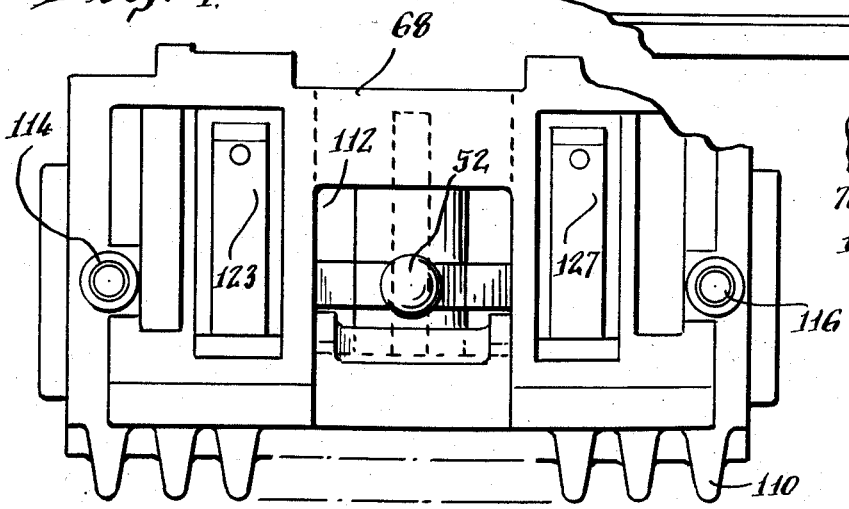
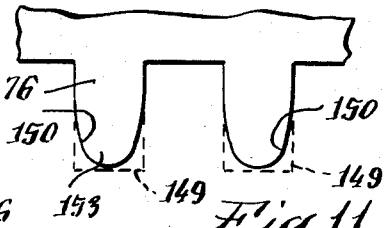
Fig. 11.
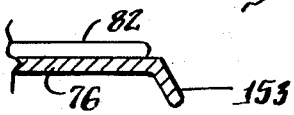
Fig. 12.

Fig. 7.
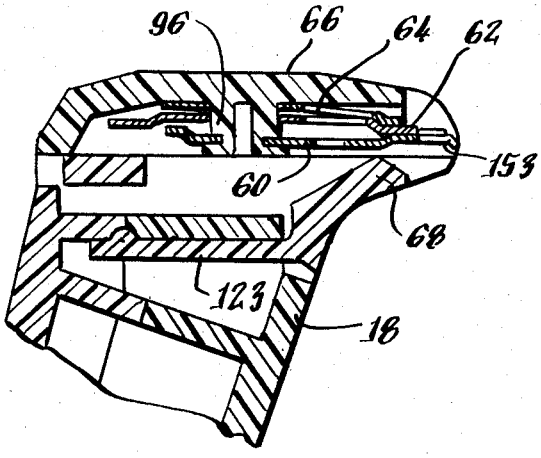
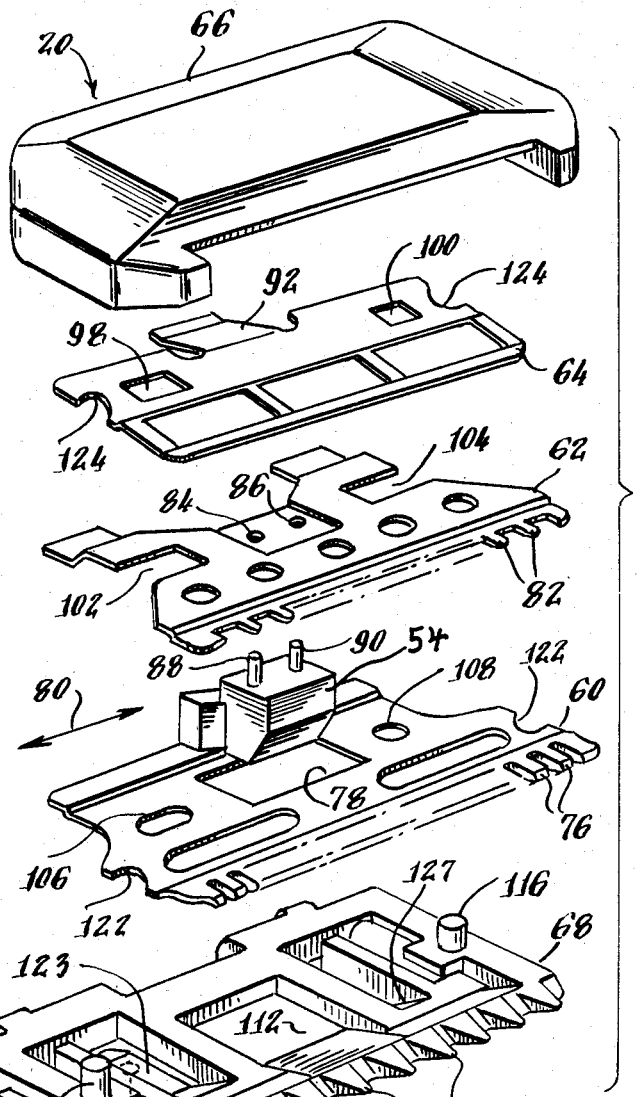
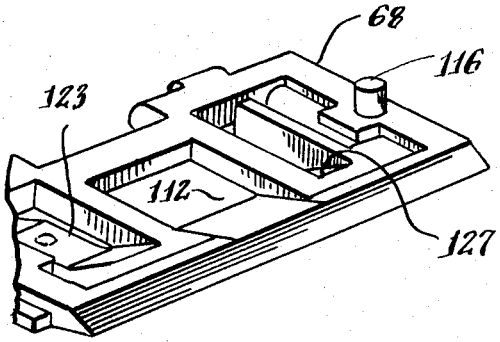
Fig. 10.
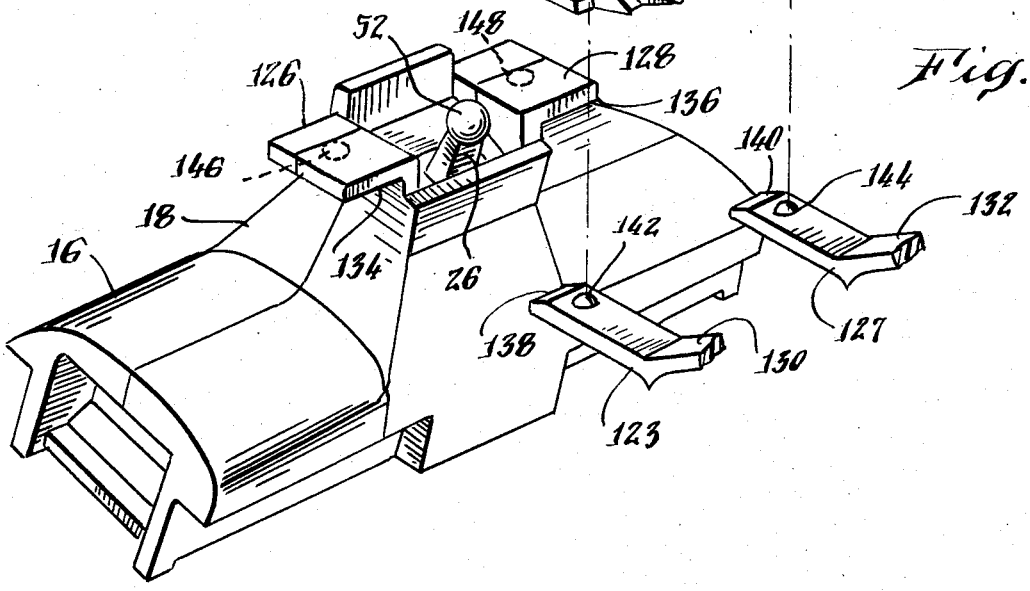
Fig. 9.

SHAVER FOR A MEDICAL TREATMENT PREPARATION PROCEDURE

BACKGROUND OF THE INVENTION

1. Field of the Invention

This invention relates to a procedure for preparing a patient prior to the administration of medical treatment. The invention relates more particularly to an improved apparatus and method which facilitates the preparation procedure.

2. Description of the Prior Art

Prior to medical treatment such as surgery, suturing, treatment of superficial wounds and fractures, etc., it is generally necessary to prepare the patient's body site at which the treatment will be administered. The preparation procedure comprises the removal of body hair, cleansing and sterlizing the body site. Body hair is removed to facilitate access, viewing and the application of various medicants. In some hospitals, the preparation procedure may be required with different patients as often as forty to sixty times each day, depending upon the day-to-day demands on the surgical department. The preparation procedure is also frequently required at more limited emergency medical facilities and at physicians' offices. Preferably, the procedure is conducted with a degree of cleanliness and sterility commensurate with the requirements of the medical treatment to be performed.

In a prior hair removal preparation procedure, body hair was removed by moistening or lathering the body site and shaving with a safety razor. Cleanliness and sterility of the hair removal procedure were obtained in large measure by the use of a sterilized, disposable blade. The blade was discarded after one use. Subsequently, the advent of an economical, disposable, safety razor made it feasible to employ the razor a single time and to discard the razor after one use.

It has been determined by medical practitioners that although a safety razor shaves the body site substantially clean of all body hair, shaving is not necessary to satisfy the needs of the medical procedure. Rather, a simple removal of relatively longer hairs, e.g., greater than one sixteenth to one eighth inch in length, is sufficient to provide the desired access and viewing. Moreover, the use of the safety razor in the preparation procedure has frequently caused small nicks and cuts in the skin at the body site. These wounds at times resulted in post-treatment infection. These two factors have led to the discontinuance, in part, of the use of a safety razor, and, the use instead of a hand held clipper. While the clipper does not crop as closely as the straight-edge razor, it does adequately remove hair and importantly avoids the introduction of skin wounds which are later susceptible to infection. However, in view of the greater cost of a clipper relative to a disposable safety razor, discarding the clipper after each use would render the procedure prohibitively expensive and the clipper is reused. The time involved in sterilizing a clipper combined with the demand for frequent and repeated use, as in a hospital facility, has necessitated that a relatively large number of sterilized clippers be provided. This requirement undesirably increases the overall cost of the hair removal procedure. Moreover, while the problem of post-treatment infection is overcome by the use of a clipper, the operation and manipulation of a hand-held, manually operated, hair clipper during the preparation procedure is at times difficult, particularly at body sites which are not readily accessible.

SUMMARY OF THE INVENTION

Accordingly, it is the object of this invention to provide an improved apparatus and method for the removal of a patient's hair from a body site at which medical treatment is to be administered.

Another object of the invention is to provide a hand-held, electrically-energized, hair clipper having an economical, disposable, cutter head.

Another object of the invention is to provide an improved cutter head for a hand-held, electrically-energized, hair clipper.

Another object of the invention is to provide a hair clipper having an improved means for maintaining shearing engagement between stationary and moving cutters.

Another object of the invention is to provide an improved means for mounting and demounting a disposable cutter head to a hair clipper.

Another object of the invention is to provide an improved drive coupling means for imparting reciprocating motion to a cutter heat from a drive source.

A further object of the invention is to provide a hair removal preparation method for a medical facility which reduces the number of hair clippers required to be available for satisfying the preparation procedure demands of the facility.

In accordance with features of the invention, an electrically-energized, hand-held, hair clipper is provided having an economical, disposable, cutter head. The cutter head comprises an assembly of a stationary cutter member and a moveable cutter member, each having an array of cutter teeth extending along an edge of the member. These members are positioned for reciprocating, sliding engagement therebetween. Corner segments of the cutter teeth are curved and an edge of the stationary cutter member extends in a direction away from a principal plane of the member. A drive coupling member is provided which is mounted to the moveable member. An oscillator member provides mechanical coupling between a drive arm and the coupling member for imparting reciprocating motion to the moveable cutter member. Sliding engagement between the cutter members is maintained by a resilient member which engages the moveable cutter member and establishes an engaging force thereon. The cutter head assembly further includes a cover member and a base member and means for mounting the cutter members, the resilient member and the coupling member in an aligned assembly between the cover and base members. Comb teeth are formed on the base member. A sliding, mounting means is provided for mounting the head assembly to a hair-clipper housing and for demounting the assembly from the housing.

This arrangement provides a relatively inexpensive, disposable cutter head which substantially reduces the possibility of nicking a patient's skin in the area to be treated. It further provides for hair clipping with either a forward pushing motion of the cutter head or a rearward drawing motion of the cutter head. Mounting and dismounting is facilitated and an enhanced oscillator coupling is provided.

In accordance with features of the method of the invention, a hand-held, electrically-energized, hair-clipper apparatus adapted for mounting a disposable, demountable, cutter head thereto is provided. The method of the procedure provides for advancing the apparatus to the body site, actuating the apparatus, manipulating the cutter head to clip hair at the body site, removing the cutter head from the apparatus, discarding the cutter head, and mounting a replacement, disposable cutter head to the hair-clipper apparatus prior to subsequent use.

BRIEF DESCRIPTION OF THE DRAWINGS

These and other objects and features of the invention will become apparent with reference to the following specification and to the drawings wherein:

FIG. 1 is a side elevation view of an embodiment of the hair clipper apparatus of this invention;

FIG. 2 is an enlarged, fragmentary, sectional view, partly broken away of the cutter head and housing of FIG. 1;

FIG. 3 is an enlarged, fragmentary view, partly broken away, taken along line 3—3 of FIG. 2;

FIG. 4 is an enlarged, fragmentary view, partly broken away, taken along line 4—4 of FIG. 2;

FIG. 7 is a fragmentary view of an alternative embodiment of a cutter head assembly of FIG. 2;

FIG. 9 is an enlarged, perspective, fragmentary, partly exploded view of the cutter head of FIG. 1;

FIG. 10 is an enlarged, fragmentary, perspective view of a base member of the cutter head assembly of FIG. 7;

FIG. 11 is an enlarged, fragmentary plan view of a stationary cutter member of the cutter head of FIG. 9; and FIG. 12 is an enlarged, fragmentary view of the cutters of FIG. 7.

DETAILED DESCRIPTION

Figure 5:
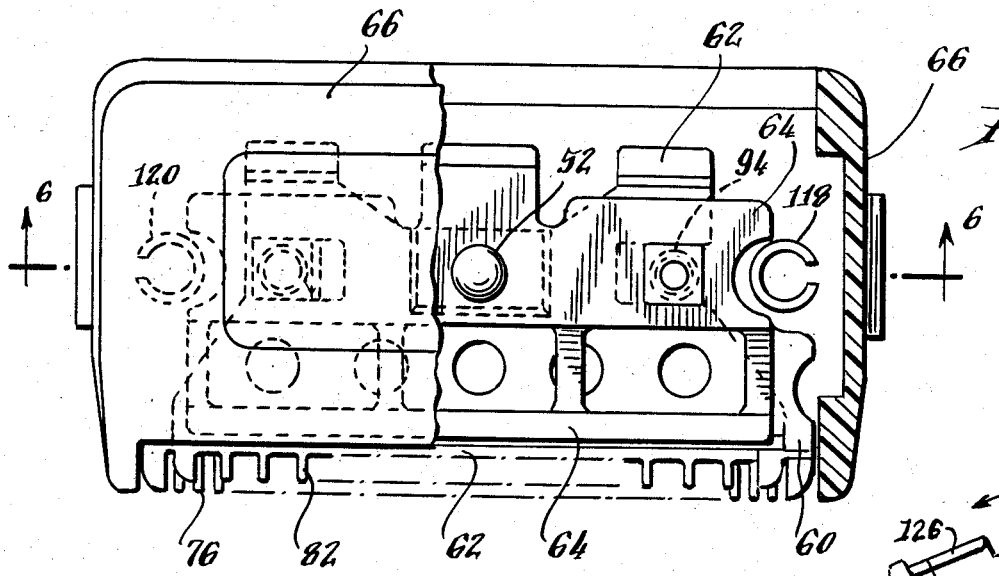
FIG. 5 is an enlarged plan view, partly broken away and partly in section, of the hair clipper apparatus of FIG. 1.

Referring now to the drawings, a hair-clipper apparatus indicated generally by reference numeral 12 is shown to have a housing body with an elongated, curved handle segment 14, a shoulder segment 16 and an elongated neck segment 18. A cutter head 20 is demountably mounted to the neck segment 18, as described more fully hereinafter. This handle, shoulder, neck and cutter head arrangement facilitates placement and manipulation of the cutter head 20 at a body site from which body hair is to be removed prior to a medical procedure. The housing is preferably formed of a polymer plastic such as a high-impact, styrene-type, rigid, thermoplastic resin material. One such material is commonly available and is sold under the tradename Cycolac.

An electrically energized means for actuating the cutter head 20 is provided and comprises an electric motor 22 positioned and supported in the housing handle segment 14. A source of alternating electrical energy, not shown, for energizing the motor 20 is coupled to the handle segment 14. Alternatively, a rechargeable electric storage means may be mounted in the handle segment. These means for energizing the motor 22 are well known in the art.

Figure 6:
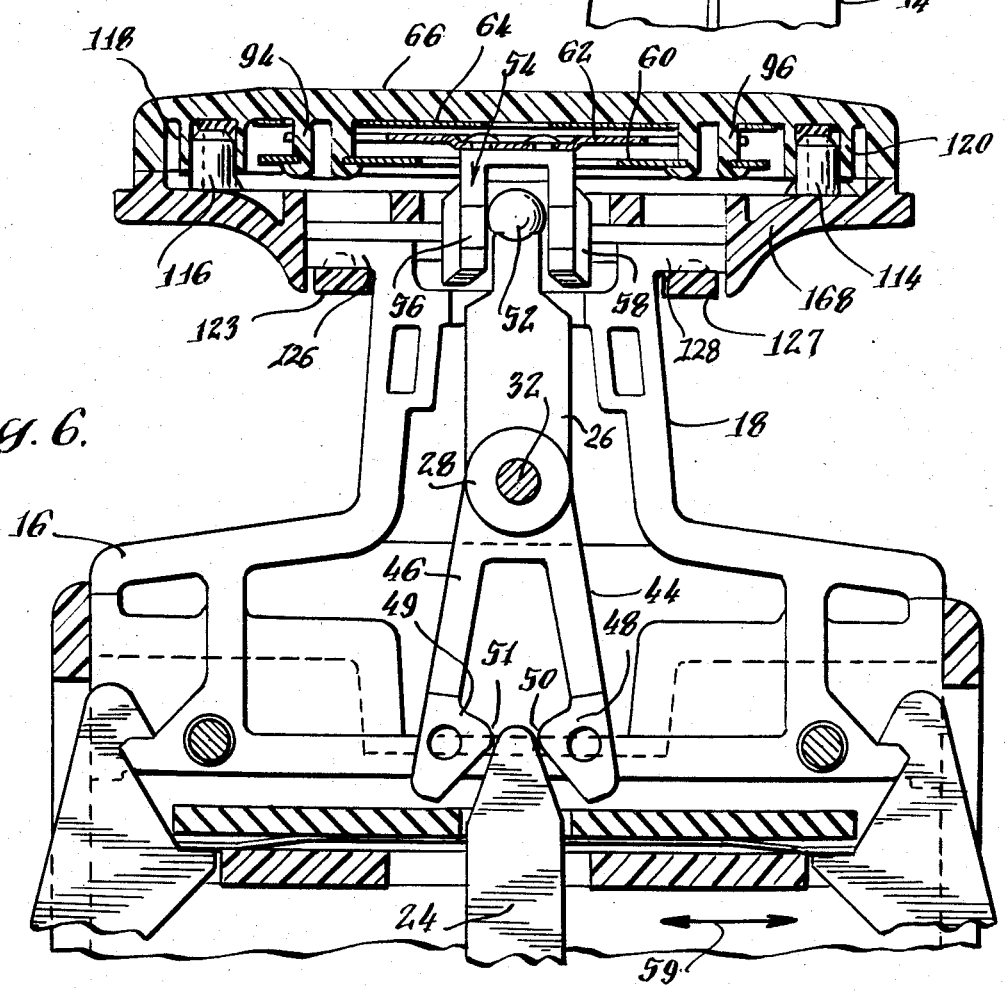
FIG. 6 is a fragmentary view taken along line 6—6 of FIG. 5.

A drive coupling means for coupling an actuating force to the cutter head 20 from the motor 22 is provided. The drive coupling means includes a reciprocating drive member 24 which is connected to an armature of the motor 22 and reciprocates therewith. This arrangement of electric motor 22 and reciprocating drive member 24 is well known in the art. One feature of this invention is the provision of an oscillator 26 which, as best seen in FIGS. 2 and 3, extends from the shoulder segment 16, through the neck segment 18 and to the cutter head 20. The oscillator member 26 includes a hub segment 28 in which a bore 30 is formed and through which an oscillator shaft 32 extends. The oscillator shaft 32 is supported in bores 34 and 38 of the neck segment 18. A spring member 42 is positioned about the shaft 32 for establishing a spring force on the member 26 and inhibits end play in the oscillating member 26 on the shaft 32. Oscillator member 26 further includes a bifurcated segment having legs 44 and 46 which extend toward, and, engage the reciprocating drive member 24. The oscillating member 26 is formed of a polymer plastic, as for example Delrin, which is available from the DuPont Corporation. Each of the bifurcated leg segments 44 and 46 includes integrally formed segments 48 and 49, respectively, which extend laterally toward each other and which resiliently engage the drive member 24. Resilient engagement is provided both by fabricating the member 26 of a material which provides some limited yield in the bifurcated configuration and by spacing distal parts 50 and 51, respectively, of the segments 48 and 49 a distance for causing slight deflection of the bifurcated leg segments when the drive member 24 extends between these segments and is positioned in engagement with the oscillator member 26. The oscillating member 26 further includes at an opposite end thereof a generally spherically shaped segment 52, which engages a cutter drive member 54. The drive member 54 includes integrally formed spaced apart wall segments 56 and 58 between which the spherical segment 52 extends. In operation, as the motor 22 is energized, the drive member 24 will oscillate with a reciprocating motion in the direction indicated by the line and arrows 59 in FIG. 6. This reciprocating motion is transmitted by the oscillator member 26 to the cutter drive member 54 causing this member to reciprocate. Member 54 is also formed of Delrin.

As best seen in the exploded view of FIG. 9, the disposable cutter head 20 comprises an assembly of a first stationary cutter member 60, the drive member 54, a second movable cutter member 62, a resilient member 64, a cover member 66 and a base member 68. The first stationary cutter member 60 comprises an elongated, metal body having a plurality of cutter teeth 76 formed along its length at one edge thereof. An aperture 78 is centrally formed in member 60 and the drive member 54 extends therethrough. The dimensions of the aperture 78 are selected to permit reciprocating motion of the drive member 54 within the aperture in the direction indicated by the arrows 80 in FIG. 9.

The movable cutter member 62 is similarly an elongated, metal body having a plurality of cutter teeth 82 formed along its length at one edge thereof. These teeth and the teeth of the stationery cutter member are configured to reduce nicking as is described more fully hereinafter. Apertures 84 and 86 are formed in the body 62 for receiving studs 88 and 90, respectively, of the drive member 54. After these studs are placed in the apertures, they are set by mechanical, heat or ultrasonic staking so that the drive member body 54 is rigidly connected to the cutter member 62.

The resilient body 64 is formed of a spring metal and includes a depending tab segment 92. When the cutter head 20 is assembled, the teeth 82 of the movable cutter member 62 will be juxtaposed with respect to the teeth 76 of the cutter member 60. The resilient body 64 operates to establish a force on the movable cutter member 62 for maintaining these teeth in sliding engagement with the teeth 76 of the stationery cutter member during operation.

The stationery cutter 60, the movable cutter 62 with the drive member 54 mounted thereto, the resilient body 64 and the cover member 66 are formed into an assembly. Cover member 66 comprises an elongated body having a generally planar configuration and an external exposed surface and is formed of a polymer plastic, such as Cycolac. Bosses 94 and 96 (FIG. 6), which are integrally formed with the cover member 66, depend from a lower surface thereof. These bosses extend respectively through apertures 98 and 100 of the resilient body 64 (FIG. 9), through slots 102 and 104 of the movable cutter member 62 and through apertures 106 and 108 of the stationery cutter member 60. The bosses are then set by mechanical, heat or ultrasonic staking to maintain these members in alignment and mounted to the head 66.

The base member 68 comprises an elongated body having a generally planar configuration and an external exposed surface and is formed of a polymer plastic, such as Cylocac, and includes a plurality of comb teeth 110 extending along its length at an edge thereof. These teeth serve to guide hair, which is to be cut, to the cutter teeth of the stationary and movable cutters 60 and 62. An aperture 112 is formed in this body for enabling extension of the drive member 54 therethrough. The base member 68 is assembled to the head cover member 66 with studs 114 and 116 which extend from the surface of the base member. These studs are located at opposite ends of the base member and extend into bores formed in bosses 118 and 120 which are integrally formed with and depend from the surface of the head member 66. The studs are secured to the bosses by any suitable means such as with ultrasonic welding, heat staking, adhesives, etc. The stationary cutter member 60 and the spring member 64 include notches 123 and 127, respectively, for providing clearance for these studs. The cover and base members 66 and 68, respectively form an enclosure for the cutter head 20.

Figure 8:
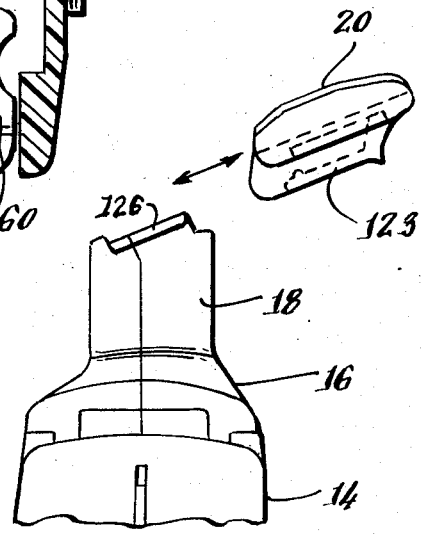
FIG. 8 is a fragmentary view of the hair clipper of FIG. 1 illustrating disassembly of the cutter head from the housing of the apparatus.

A means for demountably mounting the cutter head 20 to the neck segment 18 is provided. This mounting means comprises clip segments 123 and 127 which are integrally formed with the base member 68, a lower surface 125 of the base member 68, and collar segments 126 and 128 which are integrally formed with the neck segment 18. The clip segments 122 and 124, which are also shown fragmented in FIG. 9 for clarity, extend laterally in the direction of width of the base body 68 and depend from the body by a distance determined by the slanted depending segments 130 and 132. This distance is selected for providing a snug fit between the lower surface 125 of the base body 68 and the clips 122 and 124 as they are advanced into engagement with lower surfaces 134 and 136 of the shoulder segments 126 and 128, respectively. As will be appreciated, the fully assembled cutter head 20 is mounted by advancing it in a lateral direction as illustrated in FIG. 8, and sliding the clips 123 and 127 under the shoulders 126 and 128. The clips will advance and provide captivation of the cutter head 20 on the neck segment 18. Each of the clips 123 and 127 includes a tapered segment 138 and 140 which facilitates slight deflection and location of the clips adjacent to the lower surfaces 134 and 136. A detenting means is provided with comprises semi-spherical shaped risers 142 and 144 extending upwardly from the clips 122 and 124, respectively and which engage corresponding recesses 146 and 148 formed in lower surfaces 134 and 136, respectively. As the cutter head 20 is advanced into engagement with the neck 18, as described, the wall segments 56 and 58 of the drive member 54 which depend from the cutter head assembly 20 will straddle the spherical segment 52 of the oscillator member 26 and will be engaged therewith.

The stationary cutter teeth in accordance with one feature of the invention are configured for reducing the possibility of nicking the patient's skin during the medical preparation procedure. This is accomplished by forming the stationary cutter teeth 76, as illustrated in FIGS. 11 and 12, with corner segments which are curvilinear rather than squared off. In FIG. 11, the corners illustrated by the dashed lines 149 are eliminated and curvilinear segments 150 are provided. These curvilinear segments eliminate edges which can possibly contact, engage and nick the skin during the preparation procedure. The moveable cutter teeth are similary configured. Forming the curvilinear segments can be conveniently accomplished by a tooth piercing operation during which the teeth and curvilinear segments are formed simultaneously.

In addition, the teeth 76 of the stationary cutter 60 include at their distal locations a flanged segment 153. This flanged segment extends away from the general plane of the cutter members and operates to deflect rather than to engage skin which the cutter teeth 76 might contact. By extending this flanged segment beyond the distal edges of the moveable cutter teeth 82 as shown, and by similarly rounding the cutter teeth 82, the teeth as thus configured substantially reduce contact, engagement and nicking of the skin.

The contour of the shoulder 16, the neck 18 and the cutter head 20 are configured for facilitating ready placement and manipulation of the cutter head at the site to be trimmed and do so without obstructing visilibity of the user. It will be observed from the drawings that the neck segment 18 and the cutter head 20 have a bird like configuration with an extending beak. The cutter teeth are disposed forwardly near the edge of the beak and the size of the apparatus body itself around the cutter teeth is substantially reduced by virtue of the configuration of the neck and the shoulder and the low profile of the cutter head. Substantial visibility and facility for manipulating the cutter teeth at the site is thus provided.

The apparatus described can advantageously be used with either an advancing, pushing motion, i.e., advanced away from the user or with a rearward drawing motion, i.e., drawn toward the user. Comb teeth 110 of the base member 68 enhance the pushing motion by guiding hair to the cutters. If the apparatus is to be used in a rearward drawing motion, i.e., toward the user rather than used in an advancing pushing motion, the teeth 110 of the base member 68 can be deleted as illustrated in the embodiment of FIGS. 7 and 10.

An improved hair clipper apparatus for use in preparing a body site prior to a medical procedure has thus been described. The apparatus is advantageous in that the cutter head is readily placed and demounted from the apparatus. The cutter head assembly utilizes a relatively limited number of components which are assembled in a relatively simple and non-complex manner. This substantially reduces the cost of the cutter head and renders it enonomically disposable after each use. It is thus particularly applicable and useful in medical preparation procedures where sterile cleanliness is paramount. The cutter head arrangement further features cutter teeth configured to substantially avoid the possibility of contacting, engaging and nicking body skin during a preparation procedure. An improved oscillator member has also been disclosed which provides a resilient grip on a drive member and is readily mounted to the apparatus. The hair clipper apparatus described is particularly useful in medical preparation procedures where it is desirable to avoid infection resulting from nicking the skin and to be able to dispose of the cutter head after each use. The apparatus is further advantageous in that it can be used in trimming hair both with a forward pushing stroke or with a rearward drawing stroke.

While we have described particular embodiments of our invention, it will be apparent to those skilled in the art that variations may be made thereto without departing from the spirit of the invention and the scope of the appended claims.

What is claimed is:

1. A hair clipper having a disposable cutter head for the preparation of a body site prior to medical treatment comprising:

a. a clipper housing adapted to be hand-held during hair clipping operations;

b. an electric motor positioned in said housing;

c. a drive coupling means positioned at said housing in mechanical engagement with said motor;

d. a disposable cutter head comprising an assembly of (1) a first, stationary, cutter member having a plurality of cutter teeth, (2) a second, moveable, cutter member having a plurality of teeth, (3) said first and second cutter members positioned for reciprocating sliding engagement between said cutter teeth, (4) a resilient member establishing a force on said second cutter member for maintaining sliding engagement between said first and second cutter members, (5) a drive-coupling member mechanically engaging said second cutter member, said drive-coupling member engaging said drive coupling means and coupling an actuating drive force between said drive coupling means and said second cutter member, (6) a cover member, (7) a base member, (8) said cover member and said base member each having a generally planar configuration and having outer, exposed surfaces thereof which define an enclosure for said disposable cutter head, (9) means for mounting said cutter member, said resilient member, said drive member said cover member and said base member in a disposable assembly which enables reciprocating movement between said second movable cutter member in sliding engagement with said first stationary cutter member; and, e. a manually actuated means for mounting said disposable cutter-head assembly to said housing and for dismounting said disposable cutter head from said housing, said cutter head assembly positioned on said housing for providing engagement between said drive-coupling member of said cutter head assembly and said drive-coupling means positioned at said housing.

2. The hair clipper of claim 1 wherein said stationary cutter member, said moveable cutter member and said resilient member are mounted to said cover member.

3. The hair clipper of claim 2 wherein said drive coupling member is mounted to said moveable cutter member.

4. The hair clipper of claim 2 wherein said base member is mounted to said cover member.

5. The hair clipper of claim 1 wherein said housing includes a longitudinally extending neck segment having collar segments extending transversely to said neck segment and said cutter head assembly includes means for providing sliding engagement with and mounting of said cutter head to said collar segments.

6. The hair clipper of claim 5 wherein said base member includes said means for providing sliding engagement with said collar segments.

7. The hair clipper of claim 1 wherein said housing includes a handle segment, a shoulder segment and a neck segment and said neck segment is relatively smaller in cross sectional configuration than said shoulder and handle segments.

8. The hair clipper of claim 1 wherein said housing includes a neck segment, said disposable cutter head assembly is mounted to said neck segment, and said disposable cutter head assembly and neck segment project forwardly of said housing.

9. A hair clipper having a disposable cutter head for the preparation of a body site prior to medical treatment comprising:

a. a clipper housing adapted to be hand-held during hair clipping operations, said housing including a longitudinally extending neck segment having collar segments extending transversely to said neck segment;

b. an electric motor positioned in said housing;

c. a drive coupling means positioned at said housing in mechanical engagement with said motor;

d. a disposable cutter head comprising an assembly of (1) a first, stationary, cutter member having a plurality of cutter teeth, (2) a second, moveable, cutter member having a plurality of teeth, (3) said first and second cutter members positioned for reciprocating sliding engagement between said cutter teeth, (4) a resilient member establishing a force on said second cutter member for maintaining sliding engagement between said first and second cutter members, (5) a drive-coupling member mechanically engaging said second cutter member, said drive-coupling member engaging said drive coupling means and coupling an actuating drive force between said drive coupling means and said second cutter member, (6) a cover member, (7) a base member, (8) means for mounting said cutter member, said resilient member, said drive member said cover member and said base member in a disposable assembly which enables reciprocating movement between said second movable cutter member in sliding engagement with said first stationary cutter member; and, e. said base member having a surface thereof and a manually actuated clip means extending therefrom for providing sliding engagement between said base member and said housing collar segments and for mounting said disposable cutter head to, and, dismounting said cutter head from said housing collar segments;

f. said cutter head assembly positioned on said housing for providing engagement between said drive-coupling member of said cutter head assembly and said drive-coupling means positioned at said housing.

10. The hair clipper of claim 9 including detent means integrally formed with said collar segments and with said clip means.

11. A hair clipper having a disposable cutter head for the preparation of a body site prior to medical treatment comprising:

a. a clipper housing adapted to be hand-held during hair clipping operations;

b. an electric motor positioned in said housing;

c. a drive coupling means positioned at said housing in mechanical engagement with said motor;

d. a disposable cutter head comprising an assembly of (1) a first, stationary, cutter member having a plurality of extending cutter teeth, said teeth having a curvilinear edge configuration;

(2) a second, moveable, cutter member having a plurality of extending teeth, said teeth having a curvilinear edge configuration (3) said first and second cutter members positioned for reciprocating sliding engagement between said cutter teeth, (4) a resilient member establishing a force on said second cutter member for maintaining sliding engagement between said first and second cutter members, (5) a drive-coupling member mechanically engaging said second cutter member, said drive-coupling member engaging said drive coupling means and coupling an actuating drive force between said drive coupling means and said second cutter member, (6) a cover member, (7) a base member, (8) means for mounting said cutter member, said resilient member, said drive member said cover member and said base member in a disposable assembly which enables reciprocating movement between said second movable cutter member in sliding engagement with said first stationary cutter member; and, e. a manually actuated means for mounting said disposable cutter-head assembly to said housing and for dismounting said disposable cutter head from said housing, said cutter head assembly positioned on said housing for providing engagement between said drive-coupling member of said cutter head assembly and said drive-coupling means positioned at said housing.

12. The hair clipper of claim 11 wherein said moveable and stationary cutter members comprise elongated metal bodies extending generally in parallel planes and are juxtapositioned, said teeth of each of said members positioned in sliding engagement, and, a distal segment of the teeth of said stationary member extend in a direction away from said planes.

13. The hair clipper of claim 11 wherein said base member includes a plurality of teeth for guiding hair to the teeth of said cutter members.

14. A disposable, cutter head assembly for mounting-to and dismounting-from a housing of a hair clipper, said hair clipper having a drive member comprising:

(a) a first, stationary, cutter member having a plurality of cutter teeth;

(b) a second, moveable, cutter member having a plurality of teeth;

(c) said first and second cutter members positioned for reciprocating sliding engagement between said cutter teeth;

(d) a resilient member establishing a force on said second cutter member for maintaining sliding engagement between said first and second cutter members;

(e) a drive-coupling member mechanically engaging said second cutter member, said drive-coupling member engaging the hair clipper drive member and coupling an actuating force between the drive member and said second cutter member when said cutter head assembly is mounted to the housing;

(f) a cover member;

(g) a base member;

(h) said cover member and said base member each having a generally planar configuration and having outer, exposed surfaces thereof which define an enclosure for said disposable cutter head, (i) means for maintaining said cutter member, said resilient member, said drive member, said cover member and said base member in a disposable assembly which enables reciprocating movement between said first moveable cutter member in sliding engagement with said second stationary member; and, (j) a manually activated means positioned on said cutter-head assembly for engaging the hair clipper housing for mounting said disposable cutter-head assembly to, and dismounting said disposable cutter head assembly from, the housing of said hair clipper.

15. The disposable cutter head assembly of claim 14 wherein said stationary cutter member, said moveable cutter member and said resilient member are mounted to said cover member.

16. The disposable cutter head assembly of claim 15 wherein said drive coupling member is mounted to said moveable cutter member.

17. The disposable cutter head assembly of claim 14 including means for maintaining said cover member and said base member in fixed assembly.

18. The disposable cutter head assembly of claim 14 wherein said housing engaging means are positioned on said base member.

19. The disposable cutter head assembly of claim 18 wherein said engaging means includes a means for engaging collar segments of the hair clipper housing.

20. The disposable cutter head assembly of claim 19 wherein said means for engaging said collar segments comprises a surface of said base member and clips extending from said base member which engage surfaces of said housing collar segments.

21. The disposable cutter head assembly of claim 20 including detent means integrally formed with said clips.

22. The disposable cutter head assembly of 14 wherein said cutter members each have a plurality of extending teeth and said teeth have a curvilinear edge configuration.

23. The disposable cutter head assembly of claim 14 wherein said moveable and stationary cutter members comprise enlongated metal bodies extending generally in parallel planes and are juxtapositioned, said teeth of each of said members are positioned in sliding engagement, and, a distal segment of the teeth of said stationary member extend in a direction away from said planes.

24. A disposable, cutter head assembly for mounting-to and dismounting-from a housing of a hair clipper, said hair clipper having a drive member comprising:

(a) a first, stationary, cutter member having a plurality of cutter teeth;

(b) a second, moveable, cutter member having a plurality of teeth;

(c) said first and second cutter members positioned for reciprocating sliding engagement between said cutter teeth;

(d) a resilient member establishing a force on said second cutter member for maintaining sliding engagement between said first and second cutter members;

(e) a drive-coupling member mechanically engaging said second cutter member, said drive-coupling member engaging the hair clipper drive member and coupling an actuating force between the drive member and said second cutter member when said cutter head assembly is mounted to the housing;

(f) a cover member;

(g) a base member, said base member including a plurality of integrally formed teeth for guiding hair to the teeth of said cutter members;

(h) means for maintaining said cutter member, said resilient member, said drive member, said cover member and said base member in a disposable assembly which enables reciprocating movement between said first moveable cutter member in sliding engagement with said second stationary member; and, (i) a manually activated means positioned on said cutter-head assembly for engaging the hair clipper housing for mounting said disposable cutter-head assembly to, and dismounting said disposable cutter head assembly from, the housing of said hair clipper.

25. A hair clipper having a disposable cutter head for the preparation of a body site prior to medical treatment comprising:

a. a clipper housing adapted to be hand-held during hair clipping operations;

b. an electric motor positioned in said housing;

c. a drive coupling means positioned at said housing in mechanical engagement with said motor;

d. a disposable cutter head comprising an assembly of (1) a first, stationary, cutter member having a plurality of cutter teeth, (2) a second, moveable, cutter member having a plurality of teeth, (3) said first and second cutter members positioned for reciprocating sliding engagement between said cutter teeth, (4) a resilient member establishing a force on said second cutter member for maintaining sliding engagement between said first and second cutter members, (5) a drive-coupling member mechanically engaging said second cutter member, said drive-coupling member engaging said drive coupling means and coupling an actuating drive force between said drive coupling means and said second cutter member, (6) a cover member, (7) a base member, said base member including a plurality of integrally formed teeth for guiding hair to the teeth of said cutter members;

(8) means for mounting said cutter member, said resilient member, said drive member said cover member and said base member in a disposable assembly which enables reciprocating movement between said second movable cutter member in sliding engagement with said first stationary cutter member; and, e. a manually actuated means for mounting said disposable cutter-head assembly to said housing and for dismounting said disposable cutter head from said housing, said cutter head assembly positioned on said housing for providing engagement between said drive-coupling member of said cutter head assembly and said drive-coupling means positioned at said housing.

* * * * *